United States Patent [19]

Burk

[11] 4,126,280

[45] Nov. 21, 1978

[54] IMPACT CRUSHER

[75] Inventor: John H. Burk, Pleasant Hill, Calif.

[73] Assignee: Black Clawson, Inc., Everett, Wash.

[21] Appl. No.: 815,099

[22] Filed: Jul. 13, 1977

[51] Int. Cl.[2] ..... B02C 13/09

[52] U.S. Cl. ..... 241/275; 51/434; 241/299

[58] Field of Search ..... 241/40, 275, 299; 51/432, 434, 435

[56] References Cited

U.S. PATENT DOCUMENTS

| | | | |
|---|---|---|---|
| 3,474,974 | 10/1969 | Wood | 241/299 X |
| 3,578,254 | 5/1971 | Wood | 241/275 |
| 3,652,023 | 3/1972 | Wood | 241/275 |
| 3,955,767 | 5/1976 | Hise | 241/275 |

*Primary Examiner*—Howard N. Goldberg
*Attorney, Agent, or Firm*—Biebel, French & Nauman

[57] ABSTRACT

A centrifugal rock crusher having a cylindrical housing with a rotatively driven impeller disposed concentrically therein with a plurality of impeller vanes disposed uniformly around the impeller defining channels through which rock to be crushed is centrifugally thrown against a plurality of uniformly concentrically spaced anvils secured within the housing adjacent the impeller. The impeller is generally formed of a pair of vertically spaced upper and lower disc-shaped members which support the impeller vanes between them and together define the channels through which the rock to be crushed is thrown. Upper and lower wear plates are respectively secured to the upper and lower disc-shaped members and are angled downwardly to direct the trajectory of rocks thrown from the impeller generally horizontally against the anvils. The anvils are radially disposed in two concentric rows around the inside of the cylindrical housing with adjacent anvils being in different rows so as to present a staggered anvil pattern. The anvils are split in a vertical radial plane through the axis of rotation of the impeller so that as the anvils are worn down a hard surface portion is presented to the impacting rocks. The impeller vanes are generally triangular in horizontal cross section and have a radiused nose portion which substantially reduces the wear and destruction of the vanes. In the central portion of the impeller is a landing cone upon which the rock to be crushed is deposited and which is angled downwardly towards the channels to permit the rock to migrate into the channels before it is thrown against the anvils. The angle of slope of the cone is designed to optimize the delivery from the landing cone to the channels.

13 Claims, 11 Drawing Figures

IMPACT CRUSHER

BACKGROUND OF THE INVENTION

1. Field of the Invention

The present invention relates to impact type crushers, and more particularly, to those which utilize centrifugal force to hurl the rocks to be crushed against the anvils.

2. Prior Art

Impact type crushers which utilize centrifugal force to hurl rocks to be crushed against anvils are generally known. For example, such devices are disclosed in the following U.S. Pat. Nos. 3,767,127; 3,652,023; 3,578,254; and 3,474,974.

The developers of these types of devices have been primarily concerned with increasing the useful life span of the apparatus, particularly those portions of the apparatus which come in contact with the rock such as the impeller assembly and the anvils. These portions of the devices are subject to wear due to impingement of the rocks on the impeller vanes and upper and lower wear plates while they are accelerating the rock, and the faces of the anvils which crush the rock. These portions of the devices have therefore been designed also to be easily removable and replaceable, since substantial wearing does occur.

A difficulty associated with such prior art devices is in the utilization of horizontally disposed upper and lower surfaces forming the top and bottom of the channels defined between the impeller vanes in the impeller assembly. The use of such horizontal surfaces results in a non-horizontal trajectory of rock as it is hurled from the channels. Instead the rock tends to fly upwardly and impinge on the upper portions of the anvils, causing uneven wear and significantly reducing the useful life of the anvils.

The landing area in the central region of the impeller where the rocks are initially deposited before they are thrown from the impeller has also been a problem in the past. If the landing area is flat, it has been discovered that the rocks tend to remain on the landing area sufficiently long to wear grooves in the surface of the landing area, thus affecting the outward movement of rocks as the wearing progresses. On the other hand, it has also been discovered that if the angle of the surface of the landing area relative to the horizontal is too great the rocks to be crushed proceed radially outwardly at too fast a rate so that they are not accelerated sufficiently in rotation by the landing cone to minimize damage to the inner apex portions and the working sides of the impeller vanes.

In conventional, centrifugal rock crushers the anvils are formed as single piece castings. This results in a relatively hard outer surface but in a relatively soft core. As a result, once the hardened outer surface is worn through, further wear occurs at a rapidly increasing rate and seriously increases the frequency with which the anvils must be replaced.

SUMMARY OF THE INVENTION

The present invention provides an improved centrifugal rock crusher in which the useful life of replaceable parts is appreciably extended, thereby decreasing replacement costs and extending running times between maintenance shut downs.

This is provided by a centrifugal rock crusher having a cylindrical housing with a vertically disposed central axis, an impeller assembly disposed within the housing for rotation about the central axis between upper and lower vertically spaced disc-shaped members, a plurality of rock crushing anvils removably secured radially about the outer periphery of the impeller, the upper disc-shaped member of the impeller having a central opening defined therethrough through which rock to be crushed can pass, a plurality of substantially equally radially spaced vane members secured between the disc-shaped members about the periphery thereof for rotation therewith, substantially vertical surfaces of adjacent vane members defining channels therebetween through which rocks to be crushed can pass and be directed against the anvils, a plurality of upper and lower wear plates disposed between all adjacent vane members and respectively secured to the upper and lower disc-shaped members for rotation therewith and defining upper and lower boundaries of the channels in such a manner as to direct the trajectory of the rocks towards the anvils, and a landing cone disposed concentrically between the upper and lower disc-shaped members for rotation therewith and for receiving rocks to be crushed and distributing them to the channels, the apex of the cone being directed upwardly at an angle within a range which substantially optimizes the movement of the rock from the landing cone to the channels.

The anvils of the present invention are all disposed in two concentric rows and are evenly spaced around the circumference of the impeller with adjacent anvils in different rows. The anvils are further preferably formed in two pieces with their mating surfaces disposed in a vertical radial plane of the impeller. This provides more hardened surface portion in the central region of the anvil than is found in the soft cored one piece castings of the prior art. The much smaller softer portions of each of these anvil halves of the present invention are disposed on each side of the radial plane containing the mating faces. Thus, since the rock generally impacts in the central region of the anvils, they do not wear as fast as the prior art anvils.

The vane members which are secured to the impeller are preferably of generally triangular horizontal cross section having an apex directed radially towards the central axis of the impeller. The apex is radiused so as to reduce the wear due to impacting of the rocks thereon as they are thrown from the landing cone against the vane members.

The upper and lower wear plates which are respectively secured to the upper and lower disc-shaped members of the impeller assembly, both have their outer surfaces which form the channels between adjacent vane member, angled downwardly from the horizontal. It has been found that this results in a substantially flat trajectory for the rocks and causes them to impinge centrally of the anvils, resulting more even wear and longer anvil life.

The landing cone has been designed to provide an optimum feed rate of the rock from the landing cone area into the channels. This optimum angle is in the range of about 5° to 10° and it has further been discovered that an angle of approximately 8° 20 mins. is best suited for proper rock flow.

DETAILED DESCRIPTION OF THE PREFERRED EMBODIMENT

Figure 1:
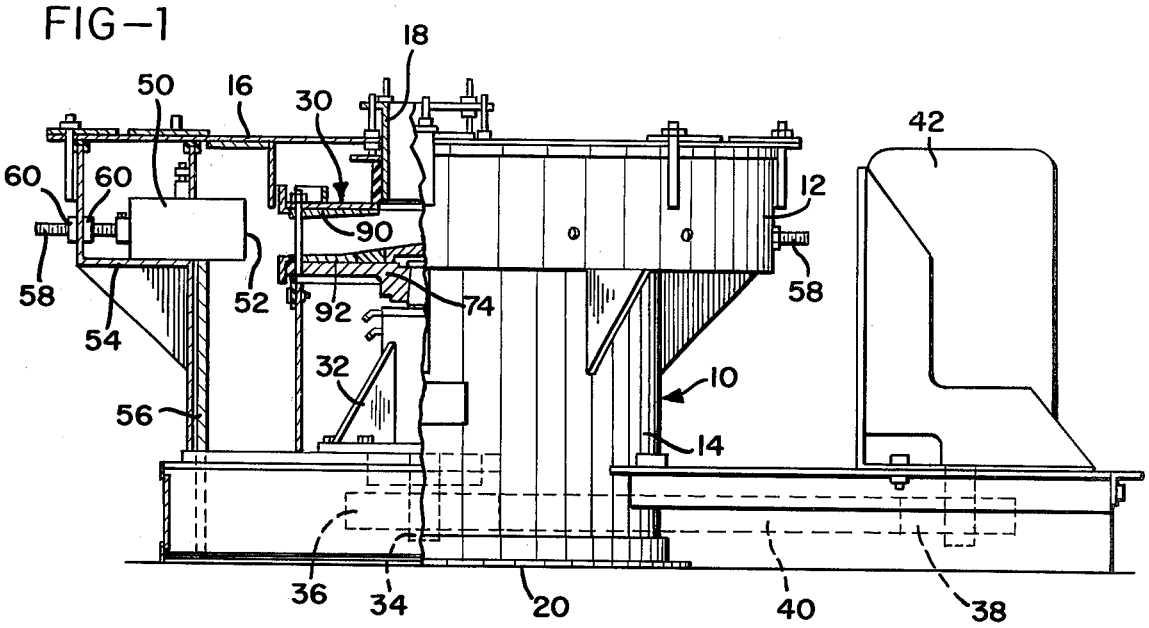
FIG. 1 is an elevational view in partial cross section of a preferred embodiment of the present invention.
Figure 2:
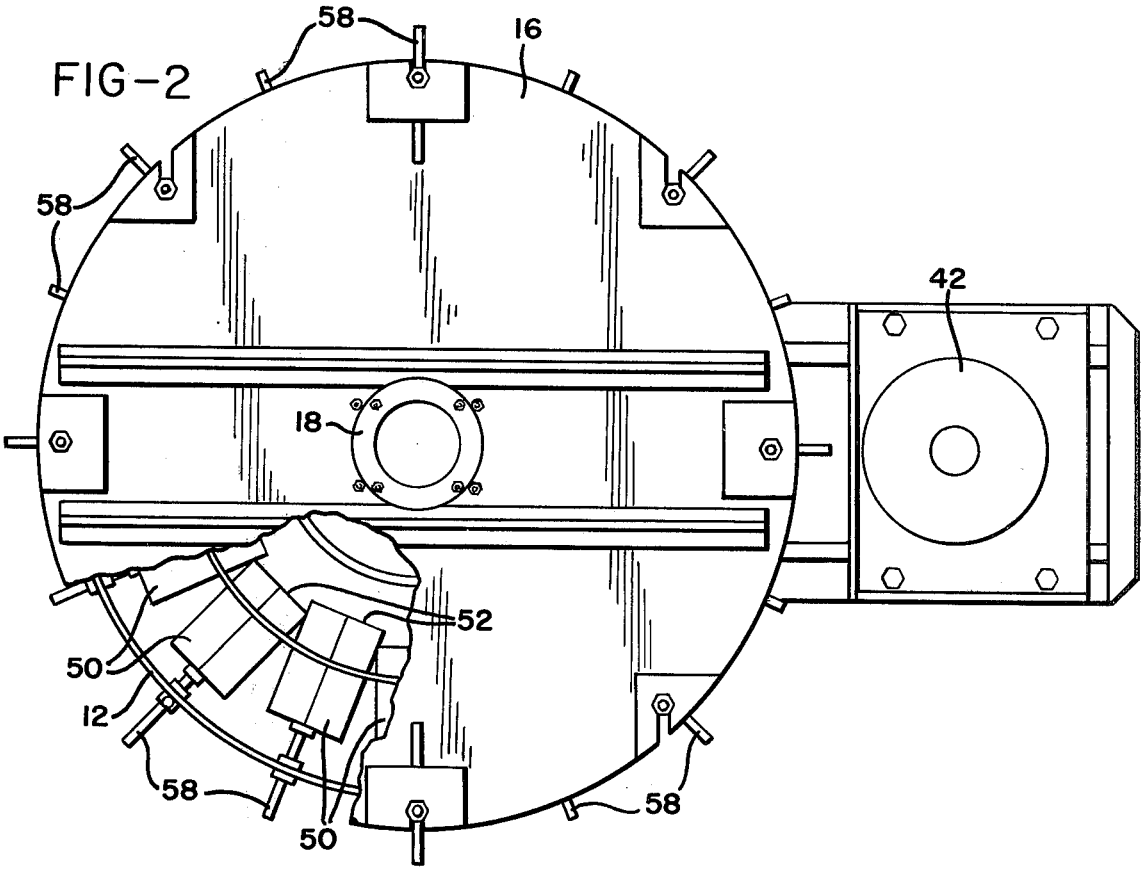
FIG. 2 is a top plan view with portions broken away of the embodiment of FIG. 1.
Figure 3:
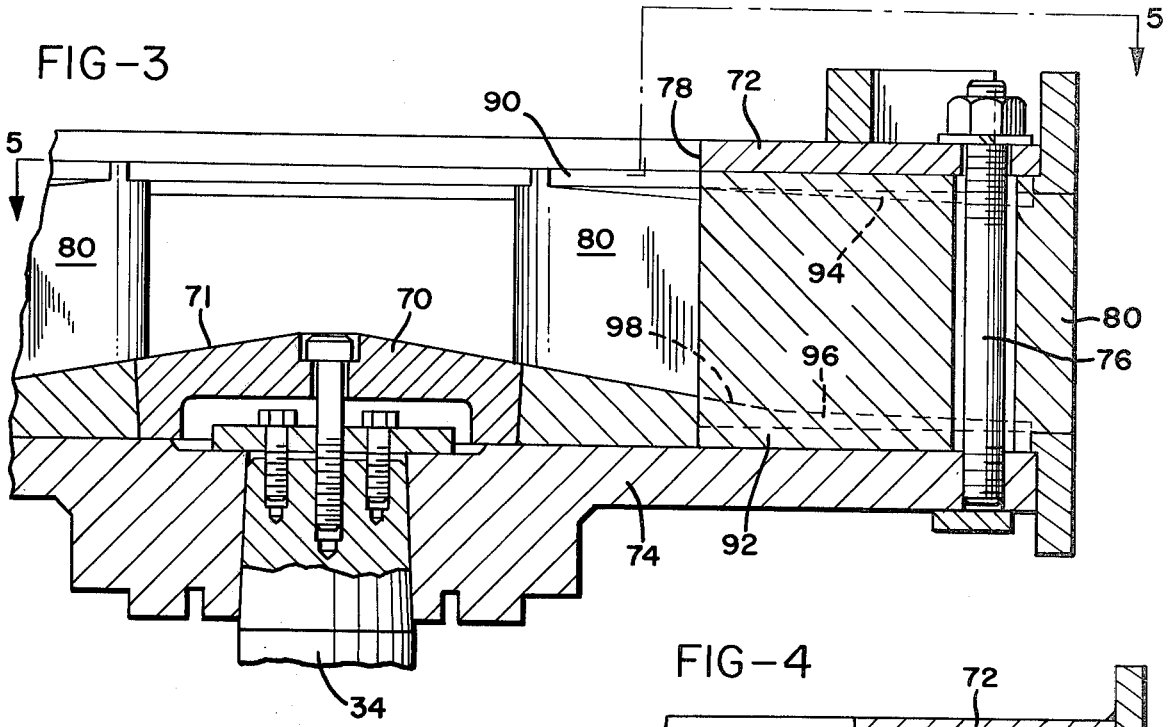
FIG. 3 is an enlarged cross sectional elevational view of a portion of the impeller assembly of the embodiment taken along line 3—3 of FIG. 5.

As best illustrated in FIGS. 1 and 2, the rock crusher of the present invention includes cylindrical housing 10 with concentric upper and lower portions 12 and 14. Upper portion 12 is of somewhat larger diameter than lower portion 14 and is provided with a top capping plate 16 carrying a central cylindrical feed tube 18 through which rock to be crushed is fed into the apparatus. The smaller diameter lower portion 14 of housing 10 is open at the bottom 20 in order to permit rock to be discharged from the apparatus once it has been crushed. The cylindrical housing 10 is usually positioned on top of a framework (not shown) which permits the rock to fall from the open bottom 20.

Disposed concentrically within housing 10 beneath the feed tube 18 is the impeller assembly 30 which is mounted for rotation in bearing support member 32. The impeller assembly 30 is driven by a central drive shaft 34 having one end extending down through bearing support member 32 into the lower portion of housing 10 where it is connected by pulleys 36 and 38 and V belt 40 to the drive motor 42.

Disposed concentrically around the impeller assembly 30 within the upper portion 12 of housing 10 are a plurality of adjustably positionable anvils 50. The anvils are disposed in two concentric rows with adjacent anvils being in different rows to provide a staggered positioning as seen in FIG. 2. The faces 52 of the anvils form a band of crushing surfaces around the impeller assembly 30 against which the rock to be crushed is centrifugally thrown by the impeller assembly.

Each anvil 50 is supported by a shelf 54 and the top edge of a cylindrical liner member 56 positioned within the housing 10 to protect the wall of housing 10 from wear. A threaded rod 58 is secured to the rear portion of each anvil 50 and extends through a corresponding hole in the wall of upper portion 12.

Nuts 60 threadably engage the rod 58 on each side of the wall of upper portion 12 in order to position each anvil 50 in a desired radial location and hold the anvil in that position. As the faces 52 of the anvils wear down due to use, the anvils 50 may be adjusted radially inwardly towards the impeller assembly 30.

Referring to the impeller assembly 30 as best seen in FIGS. 3-6, there is a landing cone 70 of circular horizontal cross section which is disposed concentrically within the impeller assembly and secured to the upper portion of drive shaft 34 for rotation therewith. Landing cone 70 is positioned directly beneath the central feed tube 18 through which the rock to be crushed is delivered onto the surface 71 of the landing cone.

An upper disc-shaped member 72 and a lower disc-shaped member 74 are disposed in vertically spaced relation concentrically with the drive shaft 34. Lower disc-shaped member 74 is secured to the drive shaft 34 for rotation therewith and upper disc-shaped member 72 is secured to the lower disc-shaped member by a plurality of bolts 76. The central portion of upper disc-shaped member 72 defines a cylindrical opening 78 through which the rocks to be crushed can pass to impinge on the landing cone 70.

A plurality of impeller vanes 80 of generally triangular horizontal cross section are disposed in equally spaced relation about the impeller assembly between upper and lower disc-shaped members 72 and 74 and are held between these members by bolts the 76 which extend through the impeller vanes 80. The apexes of vanes 80 extending radially inward towards landing cone 70 are radiused at 82 to reduce the wear on the vanes that otherwise occurs due to impingement of rocks thereon as they are centrifugally thrown outwards from the landing cone 70. The opposite sides 84 and 86 of each vane 80 are of equal length and with the walls of adjacent vanes form vertical side walls of the channels in the impeller assembly 30 through which the rock passes.

Figure 6:
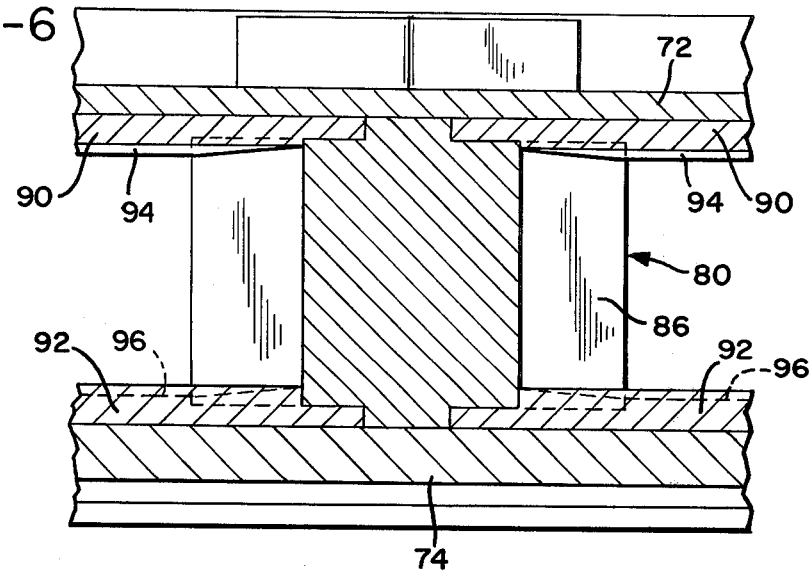
FIG. 6 is a fragmentary cross sectional elevational view of a portion of the impeller assembly looking in the direction of line 6—6 of FIG. 5.
Figure 7:
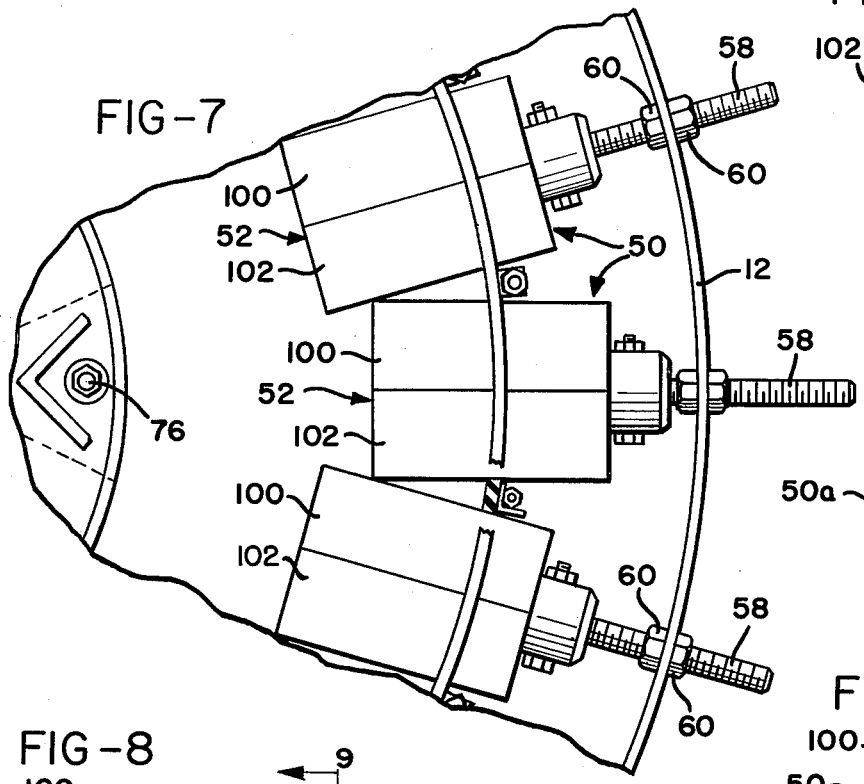
FIG. 7 is a fragmentary view of the cylindrical housing and anvils disposed adjacent the impeller assembly of the preferred embodiment.
Figure 9:
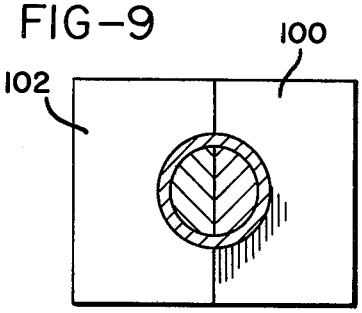
FIG. 9 is a view in the direction of line 9—9 of FIG. 8.

Forming a roof and floor of the channels are, respectively, upper and lower wear plates 90 and 92. As can be seen in FIG. 6, upper and lower wear plates 90 and 92 are held in position by engagement with corresponding grooves in the top and bottom of each vane 80 so that when bolts 76 are tightened they hold the upper and lower wear plates in position in engagement with the upper and lower disc-shaped members 72 and 74. The outer surfaces 94 and 96, respectively of upper and lower wear plates 90 and 92, are angled downwardly from a horizontal plane and outwardly from the central axis of the impeller assembly in order to direct the rock on appropriate trajectories to be hurled from the impeller assembly against the anvil faces 52.

Figure 4:
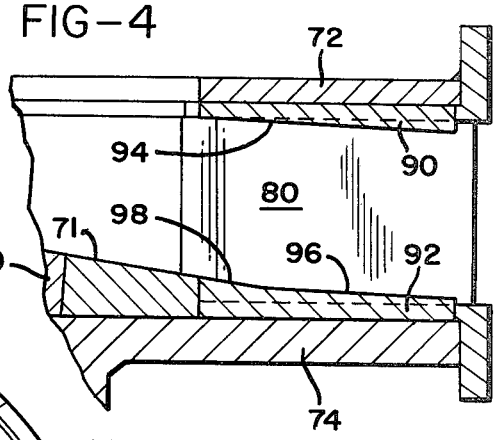
FIG. 4 is a fragmentary cross sectional elevational view of the impeller assembly taken along line 4—4 of FIG. 5 illustrating a portion of the landing cone and upper and lower wear surfaces adjacent an impeller vane member.
Figure 5:
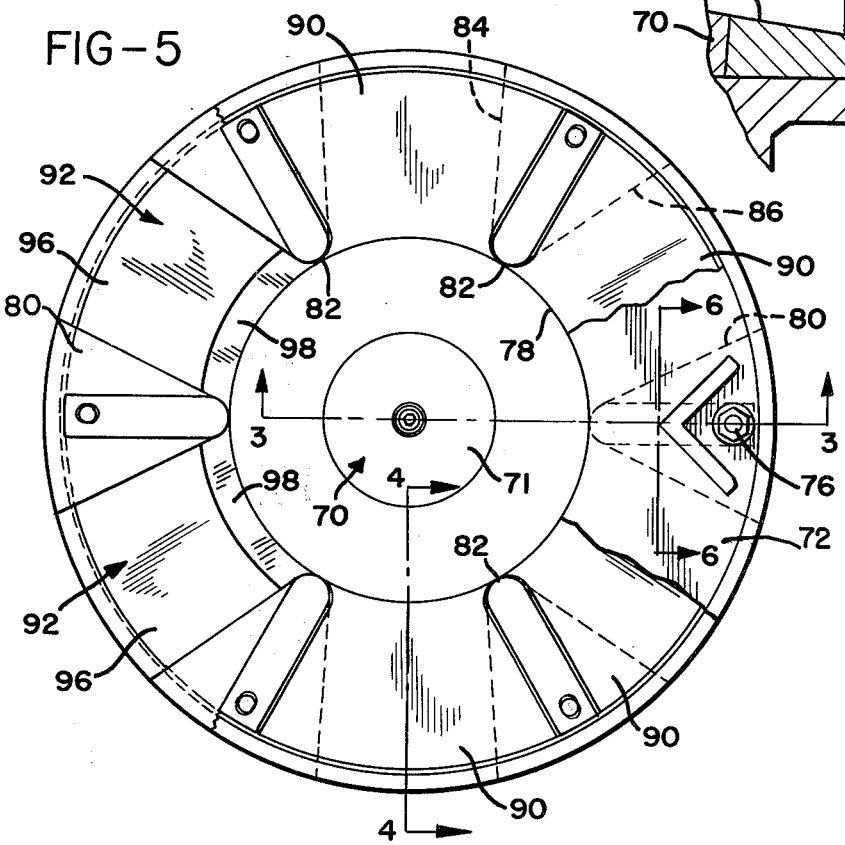
FIG. 5 is a view generally along line 5—5 of FIG. 3 with portions broken away.

As best seen in FIG. 4 the upper surface of the lower wear plate 92 which forms the floor of a channel has its outermost portion at an angle parallel to the outer surface 94 of the upper wear plate 90, and has its innermost portion 98 disposed at an angle substantially the same as the angle of the upper surface 71 of cone 70. The angle of the outer surfaces 94 and 96 relative to the horizontal plane is not great but is sufficient to insure that rock being hurled from the impeller assembly 30 has a relatively flat trajectory and impinges on the anvils 50 centrally thereof, causing more even wear and increasing anvil life.

It has been discovered, for example, that in a rock crusher of the type of the present invention in which the outer diameter of the impeller assembly 30 is approximately 38 inches, the anvil faces 52 are positioned approximately 9 to 12 inches from the impeller assembly and have a vertical height of 6 inches, the outermost height of the channel between outer surfaces 94 and 96 is approximately 5⅝ inches, and the impeller assembly is rotated at approximately 950 rpms, a downward angle of the surfaces 94 and 96 of approximately 2° is sufficient to provide a substantially flat rock trajectory.

The upper surface 71 of landing cone 70 is slanted at an angle to the horizontal in order to cause rock being delivered through the feed tube 18 to migrate outwardly into the channels of the impeller assembly from which they are thrown against the anvil faces. The angle of the surface 71 is important in that if it is too great the rocks will move radially outward too quickly and cause substantial wear on the apexes and side surfaces of the vanes 80. On the other hand, if the angle is too slight, such as a flat plate, it has been discovered that the rocks delivered from the feed tube tend to stay on the landing cone 70 and wear grooves therein which inhibits the flow of rocks outwardly through the channels defined in the impeller.

With the above referred to dimensions as an example for apparatus made in accordance with the present invention, it has been discovered that an angle of between 5° to 10° is appropriate to cause proper migration of the rock outwardly from the landing cone 70 into the channels of the impeller assembly 30. It has further been discovered that, again with the above referred to dimensions for an apparatus made in accordance with the present invention, an angle of approximately 8° 20 mins. is most suitable for proper progression of the rock radially outwardly.

By having the innermost portion 98 of the outer surface of lower wear plates 92 with the same angle as the surface 71 of cone 70, a smooth transition surface is provided between the cone and the wear plates so that the flow of rock is not disturbed..

Figure 10:
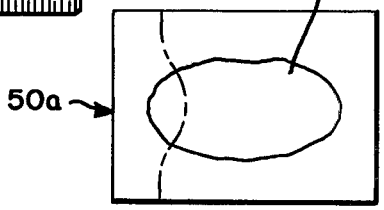
FIG. 10 is a schematic representation of a prior art anvil showing a soft central portion and hardened exterior surfaces.
Figure 11:
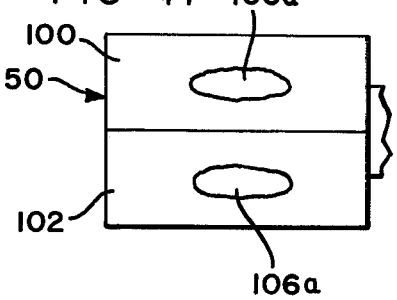
PRIOR ART FIG-11
FIG. 11 is a schematic representation of the anvil assembly of the present invention with two smaller soft cores.
Figure 8:
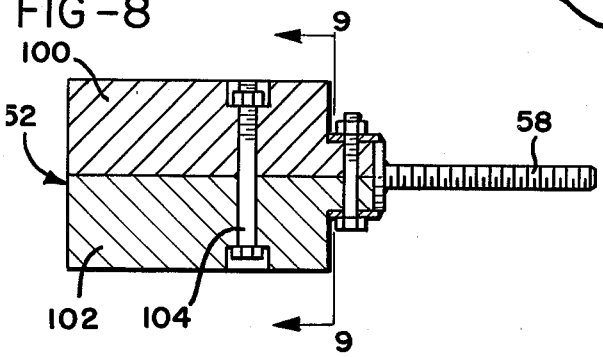
FIG. 8 is a cross sectional view of an anvil assembly of the preferred embodiment.

Referring more specifically to FIGS. 7–11, the anvils 50 are composed of two anvil halves 100 and 102 which are secured together with bolt 104 and mounted within the upper portion 12 of housing 10 so that their mating surfaces are disposed in vertical radial planes extending outwardly from the axis of rotation of the impeller assembly 30. The reason for this construction is best illustrated in FIGS. 10 and 11 in which the prior art anvil **50*a* can be compared to the anvil 50** of the present invention.

It is well known that in the heat treating of relatively large solid blocks of metal, such as those from which the anvils are made, a relatively soft central core is produced when the blocks are heat treated to harden their outer surfaces upon which the rock impinges. As the prior art anvils **50*a* are worn down from abrasion by the rocks being crushed, they are worn to the point that the soft core 106 is reached. At this point they begin to wear more quickly in the center due to the softness of the material there relative to the hardness of the material on the outer surfaces as is illustrated by the phantom line in FIG. 10**.

With the anvil 50 split in half in accordance with the present invention, the soft cores **106*a* are reduced in size, as seen in FIG. 11. In addition, now rather than having the soft central portion in the middle of the anvil as in the prior art, the assembly of the two halves 100 and 102 produces a much harder central portion in the anvil assembly 50 so that wear will progress more evenly across the face 52** of the anvil.

Referring to the manner of operation of the present invention, rocks are deposited through the feed tube 18 at a predetermined rate of supply and impinge upon the surface of landing cone 70. From there they progress outwardly due to centrifugal force created by rotation of the impeller assembly 30 via motor 42 through drive shaft 34. The rocks progress into the channels formed between the impeller vanes 80 and upper and lower wear plates 90 and 92. As the impeller assembly rotates and rocks progress outwardly, their tangential velocity is accelerated due to engagement with the vertical side surfaces of the vanes and are then flung outwardly against the faces 52 of anvils 50 where they are crushed. The crushed rocks then drop through the bottom 20 of the housing 10 and are collected.

While the form of apparatus herein described constitutes a preferred embodiment of this invention, it is to be understood that the invention is not limited to this precise form of apparatus, and that changes may be made therein without departing from the scope of the invention.

What is claimed is:

1. In a centrifugal rock crusher including a cylindrical housing with a vertically disposed central axis, a plurality of rock crushing anvil means positioned radially around the interior of said housing in a band transverse to said central axis, and impeller means disposed for rotation concentrically within said housing and adapted to throw rock to be crushed against said anvil means, the improvement comprising:

each of said anvil means has at least two anvil members with substantially vertical mating surfaces rigidly secured together, each said anvil means being secured in said housing so that said vertical mating surfaces are disposed in a radial plane of said housing.

2. A centrifugal rock crusher as defined in claim 1 wherein each said anvil member has a soft core portion and relatively harder surface portions including said mating surfaces and front surfaces upon which rock is crushed.

3. A centrifugal rock crusher as defined in claim 1 wherein said plurality of anvil means are disposed in two concentric rows with adjacent anvil means in alternate rows, each said anvil means being radially adjustably movable so as to vary the distance from said impeller means to said anvil means.

4. A centrifugal rock crusher as defined in claim 1 wherein said impeller means comprises a plurality of vane members which are generally equalaterally triangular in horizontal cross section with the bisector of the apex of the equal sides thereof lying in a radial plane, said apex being radiused sufficiently to substantially reduce wear thereof.

5. A centrifugal rock crusher, comprising:

a cylindrical housing with a vertically disposed central axis;

a plurality of rock crushing anvil means removably secured around the interior of said housing in a band transverse to said central axis and each having at least two anvil members with substantially vertical mating surfaces rigidly secured together, each said anvil means being secured in said housing so that said vertical mating surfaces are disposed in a radial plane of said housing;

an impeller means disposed for rotation concentrically within said housing and having upper and lower vertically spaced disc-shaped members in substantial aligment with said band of anvil means, said upper disc-shaped member having a central opening defined therethrough through which rock to be crushed can pass;

a plurality of substantially equally radially spaced vane members secured between said disc-shaped members about the periphery thereof for rotation therewith, substantially vertical surfaces of adjacent vane members defining channels therebetween through which rocks to be crushed can pass and be directed against said anvil means;

a plurality of upper and lower wear plates disposed between all adjacent said vane members and respectively secured to said upper and lower disc-shaped members for rotation therewith and having outer surfaces respectively defining upper and lower boundries of said channels, said outer surfaces being inclined outwardly from said central axis and downwardly at an acute angle from a horizontal plane;

landing cone means disposed concentrically between said upper and lower disc-shaped members for rotation therewith and for receiving rock to be crushed and distributing it to said channels, said landing cone means including an upper surface portion having a right frusto-conical shape with an upwardly directed apex and with the side surfaces thereof making an angle with a horizontal plane in the range of about 5° to 10°; and motor means drivingly engaging said impeller means.

6. A centrifugal rock crusher, comprising:

a cylindrical housing with a vertically disposed central axis;

a plurality of rock crushing anvil means positioned radially around the interior of said housing in a band transverse to said central axis;

an impeller means disposed for rotation concentrically within said housing and having upper and lower vertically spaced disc-shaped members in substantial alignment with said band of anvil means, said upper disc-shaped member having a central opening defined therethrough through which rock to be crushed can pass;

a plurality of substantially equally radially spaced vane members secured between said disc-shaped members about the periphery thereof for rotation therewith, substantially vertical surfaces of adjacent vane members defining channels therebetween through which rocks to be crushed can pass and be directed against said anvil means;

a plurality of upper and lower wear plates disposed between all adjacent said vane members and respectively secured to said upper and lower disc-shaped members for rotation therewith and defining upper and lower boundaries of said channels;

landing cone means disposed concentrically between said upper and lower disc-shaped members for rotation therewith and for recieving rock to be crushed and distributing it to said channels, the apex of a conical surface porition of said cone being directed upwardly;

motor means drivingly engaging said impeller means; and outer surfaces of said upper wear plates defining upper boundaries of said channels and being inclined downwardly and outwardly from said central axis at an actue angle to a horizontal to facilitate directing the trajectory of rocks thrown from said impeller generally horizontally against said anvils.

7. A centrifugal rock crusher as defined in claim 6 wherein said angle of said outer surface is approximately 2°.

8. A centrifugal rock crusher as defined in claim 7 wherein said lower wear plates have at least a substantial portion of their outer surfaces which define a lower portion of said channels inclined outwardly from said central axis and downwardly at an acute angle from a horizontal plane.

9. A centrifugal rock crusher as defined in claim 8 wherein said angle of said at least a portion of said outer surfaces of said lower wear plates is approximately 2°.

10. A centrifugal rock crusher as defined in claim 9 wherein another portion of said outer surface of said lower wear plates innermost towards said central axis is inclined outwardly and downwardly at an acute angle greater than said angle of said at least a portion of said outer surface.

11. A centrifugal rock crusher as defined in claim 10 wherein said angle of said another portion of said outer surface is in the range of 5° to 10°.

12. A centrifugal rock crusher as defined in claim 9 wherein said angle of said another portion of said outer surface is 8° 20 mins.

13. A centrifugal rock crusher as defined in claim 9 wherein said angle of said another portion of said outer surface is the same as the angle of said conical surface portion of said landing cone means.

* * * * *